United States Patent [19]

Kumar

[11] Patent Number: 4,906,520

[45] Date of Patent: Mar. 6, 1990

[54] WOVEN FABRIC FROM SPLITTABLE RIBBONS

[75] Inventor: Vijayendra Kumar, New Castle, Del.

[73] Assignee: E. I. Du Pont de Nemours and Company, Wilmington, Del.

[21] Appl. No.: 188,955

[22] Filed: May 2, 1988

[51] Int. Cl.[4] ..... B32B 7/08

[52] U.S. Cl. ..... 428/225; 26/51; 26/106; 28/240; 139/420 R; 139/420 A; 156/72; 428/95; 428/910

[58] Field of Search ..... 26/51, 106; 28/240; 139/420 R, 420 A; 156/72; 428/95, 225, 910

[56] References Cited

U.S. PATENT DOCUMENTS

| | | | |
|---|---|---|---|
| 3,110,905 | 11/1963 | Rhodes | 139/391 |
| 3,317,366 | 5/1967 | Dionne | 161/66 |
| 3,579,609 | 5/1971 | Sevenich | 264/289 |
| 3,632,687 | 1/1972 | Walter et al. | 260/896 |
| 3,707,837 | 1/1973 | Gibbon | 57/34 R |
| 3,769,815 | 11/1973 | Ploch et al. | 66/85 A |
| 3,900,549 | 8/1975 | Yamane et al. | 264/176 F |
| 4,010,303 | 3/1977 | Ramsauer et al. | 428/95 |
| 4,123,490 | 10/1978 | Gibbon | 264/147 |
| 4,129,632 | 12/1978 | Olson et al. | 264/40.1 |
| 4,478,900 | 10/1984 | Nebe et al. | 428/92 |

FOREIGN PATENT DOCUMENTS

| | | |
|---|---|---|
| 2807062 | 8/1979 | Fed. Rep. of Germany . |
| 38-4866 | 7/1963 | Japan . |
| 2878868 | 5/1966 | Japan . |

OTHER PUBLICATIONS

Faser Forshung und Textiltechnik, vol. 27, No. 12, pp. 639–647, Dec. 1976.

Textiltechnik, vol. 28, No. 6, pp. 348–353, Jun. 1978.

*Primary Examiner*—Marion C. McCamish

[57] ABSTRACT

A fabric, useful as a primary carpet backing, woven in both the warp and weft directions from filmy elements in the form of longitudinally-oriented, splittable ribbons formed from a blend of a major amount of polyester and a minor amount of a polyolefin. The ribbons split longitudinally when punctured by a tufting needle, thus providing for a more secure grip on the tufted carpet yarn than that given by conventional polyester backings. The use of polyester as a principal component overcomes certain drawbacks of polypropylene backings. Alternative processes for making these fabrics, each involving a heat-treating step at a temperature of at least 150° F. (66° C.) for a sufficient period of time to render the ribbons splittable, are also disclosed.

14 Claims, No Drawings

WOVEN FABRIC FROM SPLITTABLE RIBBONS

BACKGROUND OF THE INVENTION

This invention involves a low cost, high value woven fabric useful as a primary backing for tufted pile carpets. More specifically, the invention pertains to a woven fabric composed in both the warp and the weft directions of filmy elements in the form of longitudinally-oriented splittable ribbons formed from a blend of a major amount of polyester and a minor amount of a polyolefin, said elements having been heat-treated at a temperature of at least 150° F. (66° C.) for a sufficient time to render the elements splittable. Preferably the polyester is polyethylene terephthalate and the polyolefin is polyethylene. An advantage of the invention is that inexpensive polyester such as that recoverable from waste bottles, fibers and films is abundantly available and provides a satisfactory source of raw material.

Woven jute carpet backing has been replaced to a large extent in recent years by products made from synthetic materials. Carpet backings woven from ribbons of polypropylene, such as those disclosed in Rhodes U.S. Pat. No. 3,110,905, are the current industry standard, partly because they are strong yet inexpensive, and partly because they split longitudinally when penetrated by a carpet tufting needle. The ability to split longitudinally is highly desirable, because split ribbons close and grip the yarn securely after the needle retracts, keeping the yarn tufts firmly in position. The splitting prevents the ribbons from being severed transversely or from being severely weakened in the longitudinal direction by the penetration and removal of the tufting needles. While such products have been successful to a large extent, polypropylene has not altogether been satisfactory as the material forming the ribbons as it has the disadvantage of not being dyeable by standard carpet dyes, thus making the backing more visible and the carpet less attractive. In addition, polypropylene has a tendency to shrink at temperatures used for forming automotive carpets to desired contours and at temperatures used in bonding carpet tiles.

Polyester backings, readily dyeable with dispersed dyes and thermally stable at higher temperatures, largely overcome these particular deficiencies, and indeed spunbonded polyester backings are currently used for both automotive carpets and carpet tiles. These backings, however, are less satisfactory than those of polypropylene because they often do not grip the tufts with adequate force, and they are quite expensive. The Rhodes patent referred to above and Dionne U.S. Pat. No. 3,317,366 each describe all-polyester backings, but both tend to have the same tufting deficiencies as spunbonded backings. Rhodes discloses fabrics woven from ribbons in both directions, but the ribbons are not said to be splittable. The Dionne backing is made from flat warp ribbons and multifilament weft yarns. No mention is made of the splittable or nonsplittable nature of the warp ribbons. Without the advantages created by splittable ribbons, these polyester backings will not perform as well as polypropylene backings in firmly securing the fiber tufts in place.

Various backings which are more splittable have been suggested in an attempt to overcome the disadvantages of polypropylene while maintaining its positive features. Stitch bonded backings, made by stitching layers of splittable film or by stitching layers of a splittable film and a nonwoven, are disclosed in Ploch et al., U.S. Pat. No. 3,769,815 and Kumar, U.S. Statutory Invention Registration H90 respectively. However, these materials have high cost and poor strength in the fill or cross machine direction. A woven backing made from a blend of 80% to 65% polyamide with 20 to 35% polyester is shown in Ramsauer et al., U.S. Pat. No. 4,010,303. This is primarily a polyamide backing and has several drawbacks: (1) it is very susceptible to moisture; and (2) the ribbons, if not splittable (particularly those in the weft direction), rupture transversely when impacted by a tufting needle. This makes for an expensive and deficient backing.

DETAILED DESCRIPTION OF THE INVENTION

The present invention overcomes the problems of the patents discussed above. In one embodiment, a fabric is woven in both the warp and weft directions from filmy elements in the form of longitudinally-oriented, splittable ribbons. The ribbons are slit from a film made by extruding and drawing a blend composed of a major amount of polyester with a minor amount of a polyolefin. splittability is achieved both by the use of the polyolefin and by heat-treating, either singly or in combination, the extruded film, the slit ribbons, or the woven fabric.

As used herein the term splittability refers to the tendency of the film or the ribbons to split longitudinally when penetrated by an object such as a tufting needle. Without this tendency the film or ribbon would be left with a hole about the size of the object penetrating it or larger. When woven in a flat weave to make a fabric useful as a carpet backing, non-splittable ribbons rupture on tufting and are incapable of holding tufts adequately. On the other hand, backings made from splittable ribbons retain their integrity and hold tufts well. The ribbons tear longitudinally but do not tend to rupture transversely. The weave keeps the ribbons in place.

The process of the invention involves the preparation of a woven fabric by the steps of (1) forming a film by extruding a blend comprised of a major amount of polyester and a minor amount of a polyolefin; (2) drawing the film to give it a longitudinal orientation; (3) slitting the film to form ribbons; and (4) weaving the fabric using the ribbons in both the warp and fill directions. As noted above, there is also a heat-treating step which is necessary for achieving acceptable splittability. This step may be performed either by heating the film, the ribbons, the fabric, or some combination of the three to a temperature of at least 150° F. (66° C.) for a period of time sufficient to impart splittability.

More specifically, the film is made by extruding and drawing, preferably uniaxially, a blend of polyester, such as polyethylene terephthalate, and a polyolefin, preferably low density polyethylene, according to standard techniques in ratios of about 90:10 to about 75:25. The film may be drawn to thicknesses as low as about 1.8 to 2 mils (0.045 mm to 0.05 mm). Draw temperatures ranging from about 90° C. to about 150° C. may be used, although in general lower draw temperatures result in improved splittability. The higher the amount of polyolefin, the greater the splittability of the film.

The addition of polyolefin is essential to making the film and the ribbons more splittable, as is proper heat treatment. This heat-treating may be effected for about one minute or more at temperatures ranging from 150°

F. (66° C.) to 350° F. (177° C.). The choice of heat-treating temperature within this range is not critical, provided that it is above the melting point of the polyolefin used and below the melting point of the film. The proper duration for heat-treating at any given temperature can be determined experimentally by puncturing the film or the ribbons with a tufting needle and noting the degree of longitudinal splitting.

A preferred film for making a suitable backing has the following properties:

| | |
|---|---|
| Thickness | 2.5 to 3.0 mils (0.06 mm to 0.075 mm) |
| Tensile Strength | >50 lbs (22.7 kg) (using test method as per ASTM D1682-75 except that test is run using rate of extension of 40%/minute until breaking, rather than measuring force needed to break within 20 ± 3 seconds) |
| Elongation | >20% |
| Shrinkage | 0% at 300° F. (149° C.)<br><0.2% at 350° F. (177° C.)<br><0.5% at 350° F. (177° C.) to 400° F. (204° C.) |

This film is slit in the direction of preferential orientation and then woven into a backing with a flat weave. Preferred constructions depend on the tufter gauge and on the needle size. In a typical construction, the weft ribbon is about twice the width of the warp because the tufting needle tips are larger in this dimension. Warp ribbons may be about 0.05 inch (1.3 mm) in width, while the typical weft width is about 0.10 inch (2.5 mm). The fabric may be lubricated with silicone oil for smoother entry of the tufting needles. When nylon bulked continuous filament carpet yarn is tufted into the woven backing, there is no transverse rupturing of the ribbons, and the tufts are gripped as readily as they are in a standard polypropylene backing.

In contrast with polypropylene backings, fabrics of the present invention tend to be thermally stable at temperatures of 300° F. (149° C.) to 400° F. (204° C.). At 300° F. (149° C.) where polypropylene backings shrink, and at 350° F. (177° C.) where they melt, the fabrics of this invention are generally unaffected. The fabrics can thus be used in temperature sensitive applications such as molded automotive carpets and carpet tiles.

While primarily useful as a primary carpet backing, the fabrics of this invention can also be used in geotextile, roofing and other applications.

A further advantage of the invention is that the polyester may be scrap recovered from bottles or other waste forms of products, thus greatly reducing the cost of raw materials.

EXAMPLES

In the Examples discussed below, parts and percentages are by weight unless otherwise specified.

Several 12 mil undrawn films are extruded from a blend of recovered polyethylene terephthalate bottle waste and polyethylene resin at 10, 15 and 20% levels. These films are drawn uniaxially 4X to produce a longitudinally oriented film with a thickness of about 3 mils. Polyethylene resins used are Du Pont "Alathon" 20 and "Alathon" 2020 with melt flow indices of 1.9 and 1.1 respectively.

The drawn films are next slit and woven by conventional techniques into fabrics at 15 X 6.5 picks (ribbons per inch). The fabrics are wet-coated with a typical silicone finish and tufted on a table-top tufter. During tufting the ribbons rupture transversely without splitting, making it impossible to form a carpet.

The same backings are then heat-treated at 300° F. (149° C.) for one minute. When tufted on a table-top tufter, the ribbons split longitudinally and tuft problem-free.

I claim:

1. A woven fabric, useful as a primary carpet backing, composed in both the warp and the weft directions of filmy elements in the form of longitudinally-oriented, splittable ribbons formed from a blend of a major amount of polyester and a minor amount of a polyolefin.

2. The fabric of claim 1 where the polyester is polyethylene terephthalate.

3. The fabric of claim 1 where the polyolefin is polyethylene.

4. The fabric of claim 2 where the polyolefin is polyethylene.

5. The fabric of either claim 3 or claim 4 where the amount of polyolefin is from 10–25% by weight of the splittable film.

6. The fabric of claim 1 where the warp ribbons have an average width of about 1.3 mm, the weft ribbons have an average width of about 2.5 mm, and both have a thickness of from about 0.06 mm to about 0.075 mm.

7. A process for making a woven fabric comprising the steps of:

(a) forming a film by extruding a blend comprised of a major amount of polyester and a minor amount of a polyolefin;

(b) drawing the film to give it a longitudinal orientation;

(c) heat-treating the film at a temperature of at least 150° F. (66° C.) for a sufficient time to render it splittable;

(d) slitting the drawn and heat-treated film to form ribbons;

(e) weaving a fabric using the ribbons in both the warp and weft directions.

8. A process for making a woven fabric comprising the steps of:

(a) forming a film by extruding a blend comprised of a major amount of polyester and a minor amount of a polyolefin;

(b) drawing the film to give it a longitudinal orientation;

(c) slitting the drawn film to form ribbons;

(d) heat-treating the ribbons at a temperature of at least 150° F. (66° C.) for a sufficient time to render them splittable;

(e) weaving a fabric using the ribbons in both the warp and weft directions.

9. A process for making a woven fabric comprising the steps of:

(a) forming a film by extruding a blend comprised of a major amount of polyester and a minor amount of a polyolefin;

(b) drawing the film to give it a longitudinal orientation;

(c) slitting the drawn film to form ribbons;

(d) weaving a fabric using the ribbons in both the warp and weft directions;

(e) heat-treating the fabric at a temperature of at least 150° F. (66° C.) for a sufficient time to render it splittable;

10. The process of any of claims 7, 8, or 9 where the polyester is polyethylene terephthalate.

11. The process of claim 10 where the polyolefin is polyethylene.

12. The process of any of claims 7, 8, or 9 where the polyolefin is polyethylene.

13. The process of claim 12 where the amount of polyolefin is from 10–25% by weight of the splittable 14. The process of claim 12 where the heat treatment is effected at a temperature of about 150° F. (66° C.) to about 350° F. (177° C.).

* * * * *

UNITED STATES PATENT AND TRADEMARK OFFICE

CERTIFICATE OF CORRECTION

PATENT NO. : 4,906,520

DATED : March 6, 1990

INVENTOR(S) : Vijayendra Kumar

It is certified that error appears in the above—identified patent and that said Letters Patent is hereby corrected as shown below:

Column 6, line 2, claim 13, after "splittable" add -- film. --

Signed and Sealed this

Twenty-seventh Day of November, 1990

*Attest:*

HARRY F. MANBECK, JR.

*Attesting Officer*

*Commissioner of Patents and Trademarks*